United States Patent [19]

Crum

[11] 4,306,746

[45] Dec. 22, 1981

[54] ALL LINKAGE CLOSE-TO-THE-WALL RECLINING CHAIR

[75] Inventor: Michael A. Crum, LaGrange, Ky.

[73] Assignee: Leggett & Platt, Incorporated, Carthage, Mo.

[21] Appl. No.: 50,700

[22] Filed: Jun. 21, 1979

[51] Int. Cl.[3] ..... A47C 1/02

[52] U.S. Cl. ..... 297/85; 297/322

[58] Field of Search ..... 297/85, 83, 322, 86, 297/84, 87, 88; 5/37 R, 47

[56] References Cited

U.S. PATENT DOCUMENTS

| | | | |
|---|---|---|---|
| 3,941,417 | 3/1976 | Re | 297/85 |
| 3,958,827 | 5/1976 | Re | 297/322 |
| 4,077,663 | 3/1978 | Cycowicz et al. | 297/322 |
| 4,099,776 | 7/1978 | Crum et al. | 297/329 |
| 4,108,491 | 8/1978 | Rogers, Jr. | 297/322 |
| 4,195,878 | 4/1980 | Cycowicz et al. | 297/83 |

*Primary Examiner*—Francis K. Zugel

*Attorney, Agent, or Firm*—Wood, Herron & Evans

[57] ABSTRACT

A close-to-the-wall, three-way reclining chair having an all linkage recliner mechanism which allows the chair to move between upright, intermediate and full recline positions while the back of the chair remains a fixed distance from a wall located behind the chair. The chair incorporates a novel recliner linkage assembly for moving the seat and backrest of the chair relative to the chair's arms during movement between upright and reclined positions. The recliner linkage assembly includes a novel four bar linkage system for serving the dual function of (a) supporting the arm rests from a pair of hanger links for generally linear translatory movement during movement between upright and reclined positions, and (b) supporting the chair seat and back rest frames from the four bars for generally pivotal translatory movement between upright and reclined positions. The novel all linkage recliner mechanism is so constructed that only a minimal starting effort or motion is required to initiate movement from an upright toward a reclined position, after which the weight of the person in the chair causes the movement to be continued until the chair arrives at the first reclined or so-called TV position. Thereafter, movement from the first reclined to the full reclined position is effected by the person leaning back further in the chair or alternatively, movement is effected to the upright position from either of the two reclined positions by the person seated in the chair simply leaning forwardly.

5 Claims, 3 Drawing Figures

10
11
12
13
14
15
16
17
18
20
21
22
23
24
25
26
27
28
30
31
32
33
34
35
36
37
38
39
40
44
45
46
47
48
49
50
51
52
53
54
55
60
61
62
63
64
65
66
67
68
69
70
71
72
73
74
75
76
77
78
79
80
81
82
83
84
85
86, 87
88
89
90
91
92
93
94
96
97
98
100
101
102
103
104
105
106
107
108
109
110
111
112
113
114
115
116
117
118
119
120
121, 122
123
124
128
129
130
131
133
134
139
140
141
142
144
145
146
147
D
D'
(Fig. 1, 3a)

ALL LINKAGE CLOSE-TO-THE-WALL RECLINING CHAIR

This invention relates to reclining chairs. More particularly, this invention relates to an all linkage three-way close-to-the-wall recliner chair mechanism for enabling a reclining chair to be moved between upright, intermediate recline and full recline positions.

Reclining chairs which move between upright, intermediate recline and full recline positions, i.e., so-called three-position chairs, are well known to the prior art. In the conventional three-position type reclining chair, the body support is commonly mounted on a stationary base for pivotal movement between the upright, intermediate or so-called TV position, and full recline position. The seat and backrest may be fixed one to the other in which event the chair is referred to as a so-called "two-way" reclining chair. Or, the backrest may pivot or tilt rearwardly relative to the seat as the chair moves toward that full recline position in which event the chair is referred to as the "three-way" reclining chair. A typical such three-position "three-way" reclining chair, which includes a leg rest, and a backrest tiltable relative to the seat, is shown in U.S. Pat. No. 3,572,823, entitled "Reclining Chair", invented by E. L. Hampton.

Reclining chairs of the type described hereinabove must be disposed a substantial distance out from a wall or other obstruction which might be behind it so as to provide sufficient space to permit the chair backrest to be moved to the full recline position when desired by the user. The space which must be provided between the backrest of the reclining chair and a wall, for example, is therefore useless or waste space when the reclining chair is in the upright position. Consequently, so-called "close-to-the-wall" reclining chairs have been developed and are now popular because they eliminate the need for such space behind the chair.

One close-to-the-wall type of reclining chair which may be moved from an upright to a full recline position without any substantial rearward or aft movement of the headrest or top portion of the chair's backrest is illustrated and described in U.S. Pat. Nos. 3,858,932, entitled "Reclining Chair Assembly", invented by D. Crum, et al, and 4,099,776, entitled "Control Assembly for a Reclining Chair", invented by D. Crum, et al. The reclining chairs shown in these patents each mounts the chair's arms on a roller and track so that the complete chair other than the supporting base move forwardly as the seat and backrest are tilted from the upright to the full recline position.

Another type of reclining chair which may be moved from an upright to the full recline position without any substantial rearward or aft movement of the headrest or top portion of the chair's backrest utilizes a linkage instead of a roller slide to support the chair on the base for movement away from a wall as the chair is reclined. One such all linkage recliner is illustrated in U.S. Pat. No. 3,941,417, entitled "Reclining Chair", invented by F. M. Re. The reclining chair shown in this patent directly connects the chair's body support with each of the chair's arm rests and the chair's stationary base through use of an all linkage mechanism. In other words, the reclining chair illustrated in this patent does not make use of the roller and track structure but instead uses a series of links between the base and chair arms to carry the chair away from a wall as it is reclined. But the all linkage recliner mechanism illustrated in this patent was found to be so difficult to operate and so rough in its movements that is was never commercialized.

All the close-to-the-wall chairs described in the above identified patents have been subject to criticism because of the force required to move them from upright to full recline positions. In very nearly every instance the force required to recline close-to-the-wall recliners has been greater than the force formerly required to operate the predecessor chairs which could not be placed close to the wall. Accordingly, it has been one objective of this invention to provide a novel and unique all linkage close-to-the-wall, three-way recliner mechanism which allows movement of that chair between upright, intermediate and full recline positions, with a minimum of effort of a person seated in the chair.

It has been another objective of this invention to provide a reclining chair having a novel and unique all linkage recliner mechanism which connects the chair's base, the chair's arms, and the chair's seat and backrest, and which prevents substantial aft movement of the top of the chair's backrest as it moves from the upright to the recline positions, the arms being initially movable relative to the seat to initiate or start operation of the chair after which the weight of the chair's user functions to move the chair the remainder of the distance from the upright to intermediate recline position.

It has been still another objective of this invention to provide an improved three-position reclining chair movable between upright and recline positions in which the chair's body support and base are connected by a unique all linkage recliner mechanism, the mechanism causing substantial forward movement of the chair's seat as the chair moves from the upright to the recline positions, but the mechanism preventing movement of the chair between upright and recline positions in response to a downward force on the top edge of the chair's backrest such as might be experienced by a person standing in back of the chair and leaning normally on the top edge thereof.

The recliner chair mechanism of this invention which accomplishes these objectives comprises a novel all linkage recliner mechanism including a four bar linkage that interconnects the chair's base, backrest, seat, and arm rest so that the linkage moves into an overcenter position for retaining the chair in the upright position but which moves out of that over center position in response to a slight forward force or movement on the chair's arms relative to the chair's seat after which continued movement from the upright to intermediate recline position is achieved by the weight of the user in the chair without any additional motive power.

Other objectives and advantages of this invention will be more apparent from the following detailed description taken in conjunction with the drawings in which.

Figure 1:
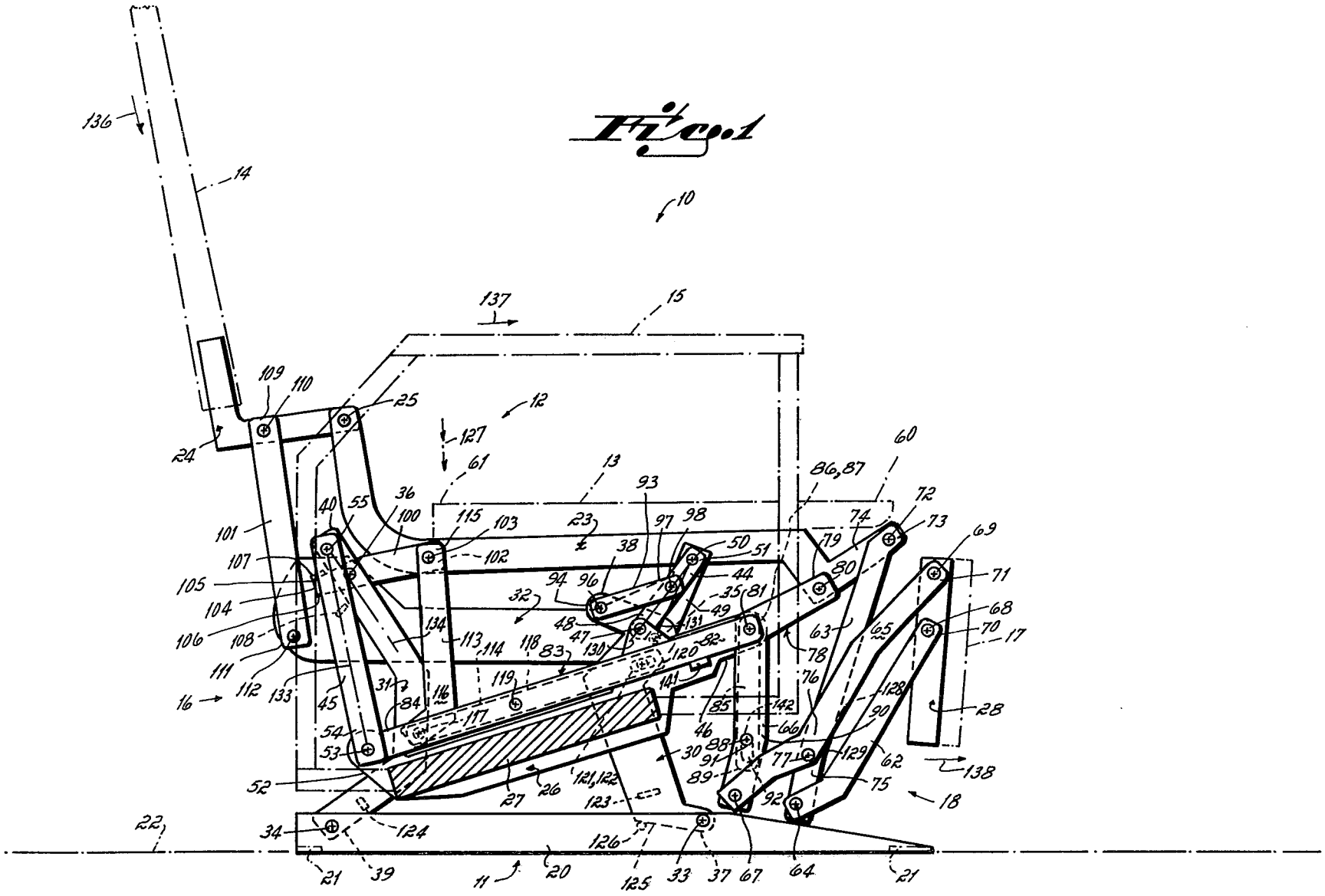
FIG. 1 illustrates a three-position reclining chair having an all linkage recliner mechanism in accord with the principles of this invention, the chair being shown in the upright position.
Figure 2:
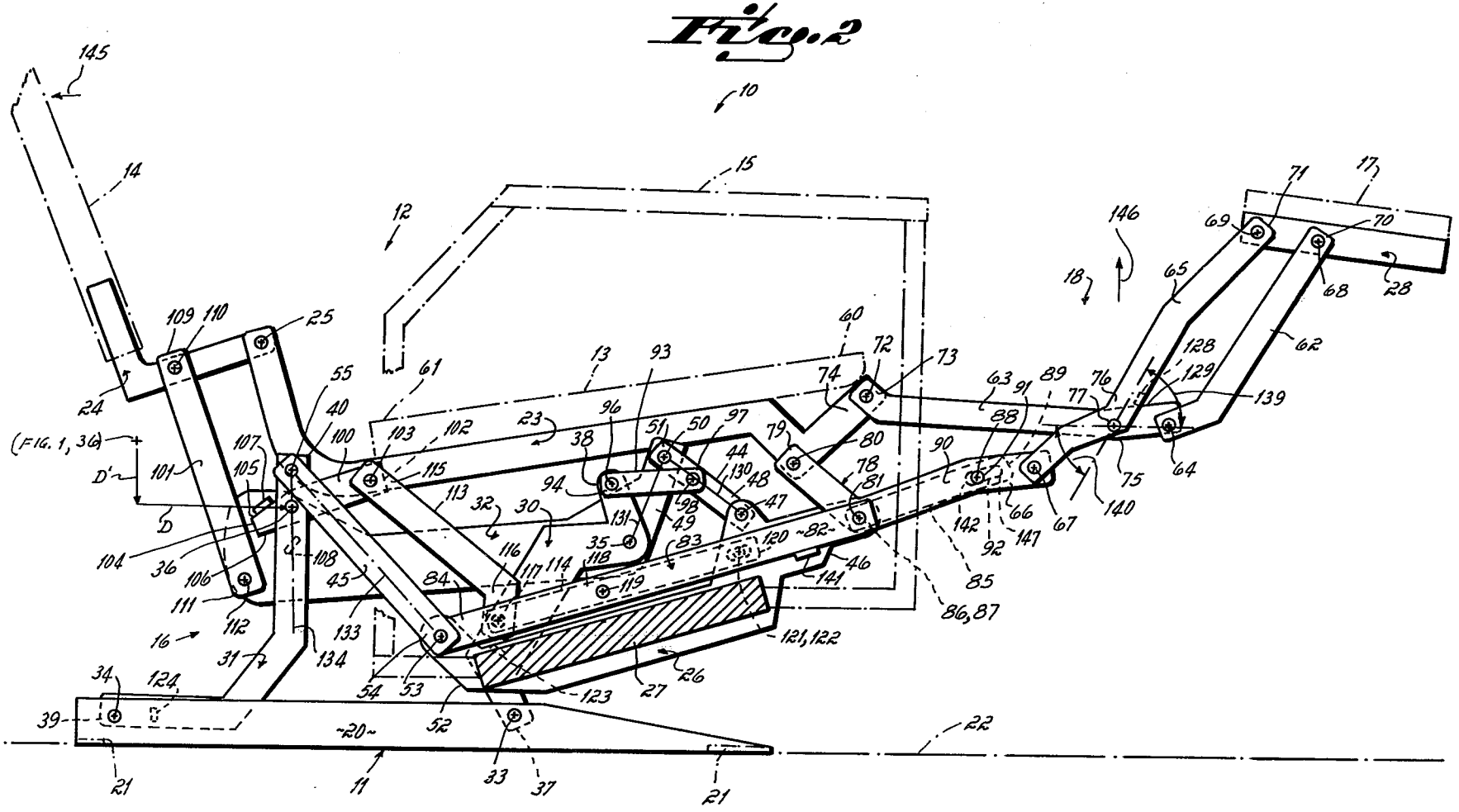
FIG. 2 is a view similar to FIG. 1 but showing the all linkage recliner mechanism in the intermediate recline or TV position.
Figure 3:
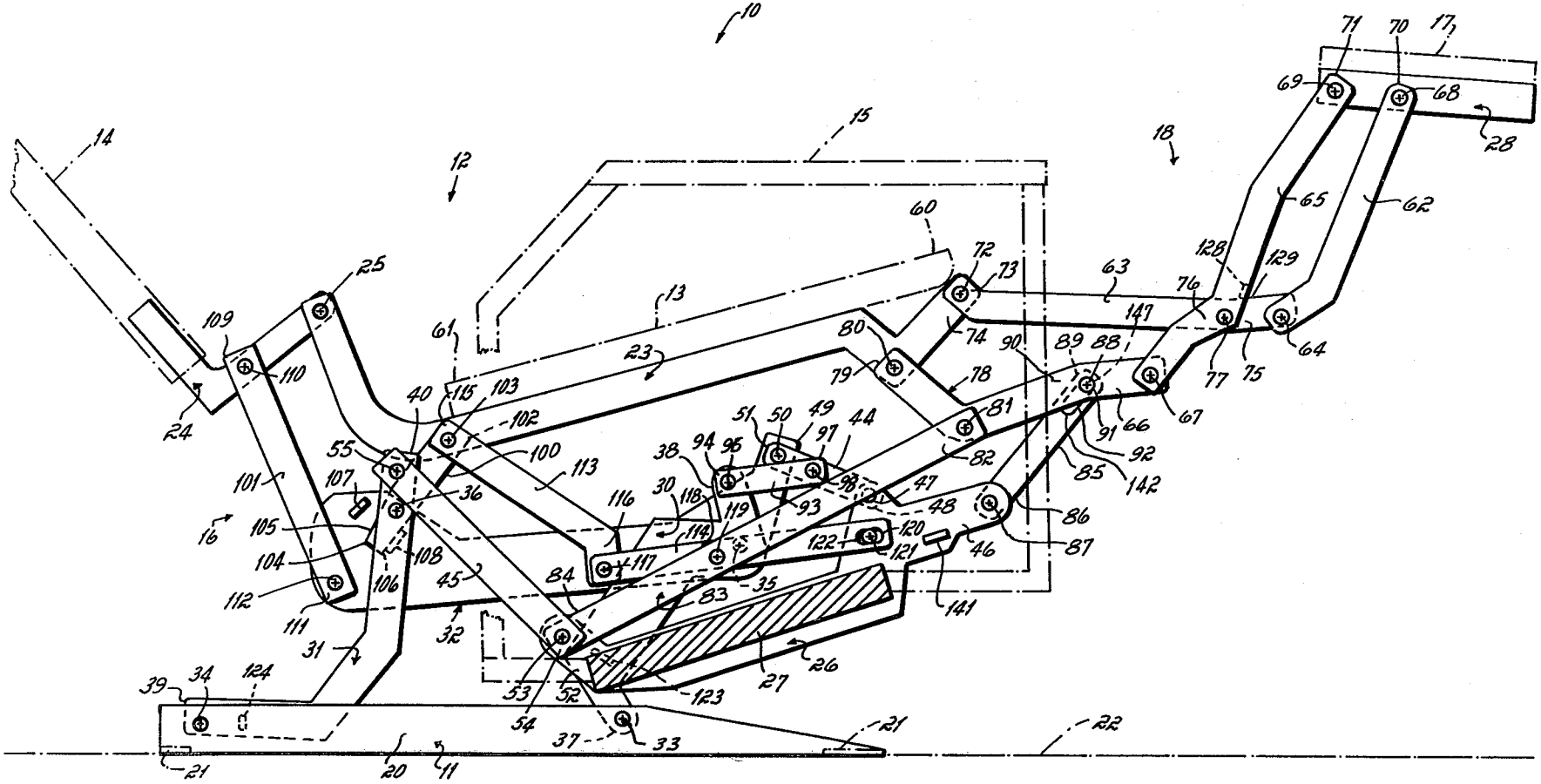
FIG. 3 is a view similar to FIGS. 1 and 2 but showing the all linkage recliner mechanism in the full recline position.

The reclining chair 10 of this invention basically includes a stationary chair base 11 and a body support 12 mounted for movement on that stationary base between upright, TV, and full recline positions, compare FIG. 1 to FIG. 2 to FIG. 3, respectively. The body support frame 12 includes a seat frame 13 and a backrest frame 14 pivotally connected one to the other. The reclining chair 10 also includes an arm rest frame 15 on each side of the seat. The chair's seat frame 13, backrest frame 14, and arm rest frames 15 are mounted on the stationary base 11, and are interconnected one with another, through recliner linkage assembly 16. The chair 10 also includes a leg rest frame 17 and leg rest linkage assembly 18, the leg rest linkage assembly being connected with the recliner linkage assembly 16 and the chair's seat frame 13. The recliner chair all linkage mechanism 16 is comprised of a recliner linkage assembly 16 and a leg rest linkage assembly 18. The recliner linkage assembly 16, leg rest linkage assembly 18 and arm rest frame 15 illustrated in FIGS. 1–3 is found on each side of the chair 10 even though the structure for only one side, the right side when considered while sitting in the chair, is shown. In other words, the recliner linkage assembly 16, leg rest linkage assembly 18 and chair's arm rest frame 15 is duplicated on opposed sides of the chair (only one side being shown in the drawings for purposes of illustration), each recliner linkage assembly connecting the chair's stationary base 11, arm rest frame 15, seat frame 13 and backrest frame 14 on each side of the chair, and each leg rest linkage assembly connecting the chair's seat frame 13 and recliner linkage assembly 16 with leg rest frame 17 on each side of the chair. Further, and although the figures only show the framework 13, 14, 15, 17 for the chair's seat, backrest, arms and leg rest, it will be understood that such framework is suitably adapted for receiving appropriate spring elements, cushioning, upholstery and the like for completion of a saleable product. In other words, the springs, cushioning and covering of the chair 10 have been eliminated for clarity of illustration in the drawings of this invention. Each of the three positions of this three-position all linkage reclining chair 10 is illustrated in one of the FIGS. 1–3. FIG. 1 illustrates the position of the recliner linkage assembly 16 and the leg rest linkage assembly 18 when the chair 10 is upright; FIG. 2 illustrates the position of the recliner linkage assembly when the chair is in the intermediate recline or TV position; and FIG. 3 illustrates the position of the recliner linkage assembly and the leg rest linkage assembly when the chair is in the full recline position. As viewed in FIGS. 1–3, the arm rest frame 15 is located outboard of the linkage assembly 16 (supported from a base member 27 which is also located outboard of the linkage assembly 16) and the seat frame 13 is located inboard of the linkage assembly 16.

The reclining chair 10, as previously mentioned, includes a base frame 11 which is comprised of a base plate 20 on each side thereof (only one of which is shown). The base plates 20 are connected one with the other by cross frame members 21, thereby providing a generally square or rectangular base frame 11 for the chair 10 that is stationary relative to ground 22. Each side of the chair 10 also includes a seat frame mounting plate 23 on which the chair's seat frame 13 is fixed, and a back frame mounting plate 24 on which the chair's back rest frame 14 is fixed, the backrest 24 and seat frame 23 mounting plates being pivotally connected one to the other at axis 25. Each side of the chair also includes an arm frame mounting plate 26 to which base member 27 of arm rest frame 15 is fixed. Each side of the chair also includes a leg frame mounting plate 28 to which the leg rest frame 17 is fixed. The seat frame mounting plate 23, backrest frame mounting plate 24 and arm rest frame mounting plate 26 are all interconnected one with another by the recliner linkage assembly which is comprised solely of mechanical links. In other words, the chair 10 incorporates no secondary or body support frame which rolls on roller and track means relative to the stationary base. The leg frame mounting plate 28 is connected with the seat frame mounting plate 23 and with the arm rest frame mounting plate 26 by the leg rest linkage assembly 18 which also is comprised solely of mechanical links.

The recliner linkage assembly 16 on each side of the reclining chair 10 includes a basic four bar linkage from which the arm rest frame mounting plate 26 is hung, and to which the seat frame mounting plate 23 and back frame mounting plate 24 are connected. This four bar linkage includes the chair base's base plate 20, a front carrier link 30 (dog legged rearwardly) pivotally connected to the base plate 20 at axis 33, and a rear carrier link 31 (dog legged forwardly) pivotally connected at the base plate 20 at axis 34. The front 30 and rear 31 carrier links are pivotally connected one with the other by control mounting links 32 at axes 35, 36, respectively. Note that this interconnection 35, 36 with the control mounting link of each of the front and rear carrier links is at a point intermediate the end 37, 38 and 39, 40 of the front 30 and rear 31 carrier links, respectively. In other words, the front 30 and rear 31 carrier links are pivotally connected at their lower ends 37, 39 to the base plate 20 of base frame 11, and pivotally connected intermediate their ends 37, 38 and 39, 40 to the control mounting link 32. The movable control mounting link 32, the movable front 30 and rear 31 carrier links and the stationary base plate 20, constitute what is hereinafter referred to as a four bar linkage.

The arm rest mounting plate 26 is hung from the four bar linkage 20, 30–32, by front 44 and rear 45 hanger links as shown. The forward end 46 of the arm rest mounting plate 26 is pivotally connected at axis 47 to lower end 48 of the front hanger link 44, and the forward end 49 of control mounting link 32 is pivotally connected at axis 50 to top end 51 of the hanger link 44. Note that, relative to ground 22, this upper pivot point connection 50 of the front hanger link 44 with the control mounting link 32 is positioned above the pivot connection 35 of the front carrier link 30 with the control mounting link 32. Note also (from a comparison of lines 130, 131) that the pivot connection 47 of the front hanger link 44 with the arm rest mounting plate 26 is located rearwardly or overcenter relative to the pivot point connection 35 of the front carrier link 30 with the control mounting link 32 when the chair is in the upright position shown in FIG. 1, and is located forwardly of that front carrier link 30/control mounting link 32 pivot point connection 35 when the chair is in the intermediate recline and full recline positions shown in FIGS. 2 and 3; the significance of this structural relation is set out in greater detail below. The rear end 52 of the arm rest mounting plate 26 is connected to rear carrier link via the rear hanger link. The rear hanger link 45 is pivotally connected at its lower end 54 on pivot axis 53 to the rear end 52 of arm rest mounting plate 26, and is pivotally connected on pivot axis 55 at its upper end 56 to the top end 40 of the rear hanger link 31. As with the front hanger link 44 relative to the front carrier link 30 and relative to ground 22, note that pivot connection 55 of the rear hanger link 45 with the rear carrier link 31 is positioned substantially above the pivot connection 36 of the rear carrier link 31 with the control mounting link 32. Note also (from comparison of lines 133, 134) that the pivot connection 53 of the rear hanger link 45 with the arm rest mounting plate 26 is located rearwardly or overcenter relative to the pivot connector 36 of the rear carrier link 31 with the control mounting link 32 when the chair is in the upright position shown in FIG. 1, and is located forwardly of that rear carrier link 31/control mounting link 32 pivot connection 36 when the chair is in the intermediate recline and full recline positions shown in FIGS. 2 and 3; the significance of this structural relation is set out in greater detail below. Thus, the arm rest frame 15, through the arm rest mounting plate 26, is hung from the control mounting link 32 at the forward 47 and rearward 52 ends thereof by front 44 and rear 45 hanger links, respectively, through use of front 30 and rear 31 carrier links, respectively, i.e., is hung from the four bar linkage 20, 30–32, in such a manner that the arm rest frame 15 (through hanger links 44, 45) move between an upright overcenter position and recline reverse positions as explained in greater detail below.

The chair's seat frame 13, i.e., seat mounting plate 23, at front end 60 thereof is supported in connected relation with the chair's base 11 through the leg rest linkage assembly 18, in a manner to be described, and at rear end 61 thereof is supported in connected relation with the chair's base 11, through the recliner linkage assembly 16. The leg rest linkage assembly 18 is in the form of a double V lazy tong linkage of the conventional overlapped V type. The leg rest linkage assembly 18 includes links 62, 63 that form a front V pair pivotally connected on axis 64, and links 65, 66 that form a rear V pair pivotally connected on axis 67. The front links 62, 65 of each V pair are pivotally connected on axes 68, 69, respectively, at their free ends 70, 71, respectively, to leg rest frame mounting plate 28, and hence, to leg rest frame 17. The rear link 63 of the front V link pair is pivotally connected on axis 72 at its free end 73 to the front end 74 of the seat mounting plate 23, is pivotally connected at its mid-portion 75 to mid-portion 76 of the second V link pair's front link 65 on axis 77. The rear link 66 of the rear V link pair 65, 66 is formed integral with locator link 78 in a dog leg configuration. The free end 79 of locator link 78 is pivotally connected on axis 80 to the front end 74 of the seat frame mounting plate 23. Also, end 78 of the rear V link pair's rear link 66 is pivotally connected on axis 81 to one end 82 of a primary drive link 83, the other end 84 of that primary drive link being pivotally connected on axis 53 to the rear end 52 of the arm rest mounting plate 26. Further, a lock link 85 is pivotally connected at one end 86 on axis 87 to front end 46 of the arm rest mounting plate 26, and is pivotally connected on axis 88 at its other end 89 to a mid-portion 90 of the rear V link pair's rear link 66. The pivot axis 88 is movable relative to the lock link 85 through use of pin 91 fixed to rear link 66 and lost motion slot 92 in the lock link 85. The double V lazy tong linkage 18 is thus connected through primary drive link 83 with the rear 52 of the arm rest mounting plate 26 (and, hence, the arm rest frame 13) on the same pivot axes 53 at which the rear hanger link 45 is connected to that arm rest mounting plate 26 and is connected through locator link 78 with the front 74 of the seat frame mounting plate 23. Further, the lazy tong linkage 18 is connected with the front end 46 of the arm rest mounting plate 26 through lock link 85. Thus, the leg rest linkage 18 is connected to both front and rear ends 46, 52 of the arm rest mounting plate 26 (and, hence, to arm rest frame 15) through primary drive link 83 and lock link 85, and is connected to front end 74 of the seat mounting plate 23 (and, hence, seat frame 13) through locator link 78.

The leg rest extension linkages' primary drive link 83, as previously noted, is connected to arm rest mounting plate 26 on axis 53. The leg rest extension linkage 18, however, also includes a secondary drive link 93 which pivotally connects at one end 94 with the top end 38 of the front carrier link 30 on axis 96, and which pivotally connects at its other end 97 on pivot axis 98 intermediate the ends of the front hanger link 44. Therefore, the primary drive link 83 is connected with the rear carrier link 31 through the rear hanger link 45, and secondary drive link 93 is connected with the front carrier link 30 through the front hanger link 44.

The rear edge 61 of the chair's seat frame 13 is connected to the recliner linkage assembly 16 by a full recline linkage that includes full recline link 100 and back support link 101. The full recline link 100 is pivotally connected at one end 102 to the seat frame mounting plate 23 as at axis 103, and is pivotally connected intermediate its ends to the four bar linkage's control mounting plate 32 on pivot axis 36. The other end 104 of the full recline link 100 includes upper 105 and lower 106 bearing surfaces adapted to cooperate with upper 107 and lower 108 stops affixed to the control mounting link 32. The back support link 101 is pivotally connected at one end 109 and axis 110 to the back frame mounting plate 24, and is pivotally connected at the other end 111 on axis 112 to the control mounting link. The full recline link 100 (and, hence, seat mounting plate 23) is also connected with the leg rest linkage assembly 18 through control links 113, 114. The rear control link 113 is pivotally connected at one end 115 on axis 103 to the full recline link 100 and seat mounting plate 23, and is pivotally connected at its other end 116 on axis 117 to the front control link 114. The front control link 114 is pivotally connected intermediate its ends at mid-portion 118 on axis 119 to the primary drive link 83 of the leg rest linkage assembly 18. The front control link 114 also is pivotally connected at its front end 120 on relatively movable pivot axis 121 to the front end 46 of arm rest frame mounting plate 26 through lost motion slot 122 in the front end of that front control link. This control link 113, 114 structure thereby interconnects the leg rest extension linkage 18 with the full recline link 100.

Ears 123, 124 on the front 30 and rear 31 carrier links are provided so that the front carrier links 30 on each side of the chair can be rigidly connected by a front brace member (not shown) and so that rear carrier links 31 on each side of the chair can be rigidly connected by a rear brace member (not shown). These brace members (not shown) insure that the recliner linkage 16 and leg rest extension linkage 18 on each side of the chair 10 remains aligned properly one with the other as the chair moves between its FIG. 1 and FIG. 3 positions.

In use, the upright position of the three-position reclining chair of this invention is illustrated in FIG. 1. The use sequence of upright to intermediate recline or TV position to full recline position is illustrated in FIGS. 1 to 2 to 3, respectively. Also, of course, the reverse sequence from full recline position to intermediate or TV position and back to upright position is illustrated from FIGS. 3 to 2 to 1, respectively.

In the upright position, and as shown in FIG. 1, the chair 10 is retained or stopped in the upright position because stop edge 125 of the front carrier link 30 is seated on stop pin 126 fixed to the base frame's member 20. Further, stop edge 105 of the full recline link 100 is butted against stop 107 mounted on the control mounting link 32. This position of the front carrier link 30 and full recline link 100 (and, hence, of the recliner linkage 16) is maintained because a user's weight (as indicated by phantom arrow 127) is generally concentrated toward the rear edge 61 of the chair's seat frame 13. This force 127 tends to pivot the full recline link 100 clockwise as shown in the figures against upper stop 107, and tends to pivot the front carrier link 30 counterclockwise as shown in the figures against the stop pin 126. In the FIG. 1 position, the seat's backrest frame 14 is retained in the upright position because of the back support link 101 which connects the four bar linkage assembly's control mounting link 32 to the backrest mounting plate 24. Further, the leg rest linkage 18 is retained in the retracted position because of the rearward position of arm rest mounting plate 26 (as established by front carrier link 30) and primary 83 and secondary 93 drive links. The leg rest linkage 18 is established at the fixed retracted location by stop pin 128 fixed to the front V link pair's rear link 65 that abuts stop edge 129 on the rear V link pair's front link 63. This stop pin 128/link 63 structure also locates the rear end 54 of the arm rest mounting plate 26 and the rear carrier link 31 in the upright position, and also prevents the leg rest linkage assembly 18 from hanging up in the retracted position. Note in this upright chair position that the pivot axis 47 connector of the front hanger link 44 with the arm rest mounting plate 26 is to the left of or overcenter relative to the pivot axis 35 connection of the front carrier link 30 with the four bar linkage's control mounting link 32, i.e., phantom line 130 that connects pivot axes 50, 47 is overcenter relative to phantom line 131 that connects pivot axes 50, 35. Further, note that pivot axis 53 connection of the rear hanger link 45 with the arm rest mounting plate 26 is to the left of or overcenter relative to the pivot axis 36 connection of the rear carrier link 30 with the four bar linkage's control mounting link 32, i.e., phantom line 133 that connects pivot axes 55, 53 is overcenter relative to phantom line 134 that connects pivot axes 55, 36. This overcenter front hanger 44/rear hanger 45 linkage structure tends to retain the recliner linkage assembly 16 in the upright chair attitude while a person sits down on the chair, i.e., when force is exerted on the chair as illustrated by phantom arrow 127. Further, this overcenter hanger 44, 45 linkage posture tends to prevent the recliner linkage assembly 16 from extending from the upright position shown in FIG. 1 toward the intermediate or TV recline position shown in FIG. 2 in response to a downward force shown by phantom arrow 136 on the top edge (not shown) of the chair's backrest frame 14. This type of downward force 136 on the backrest frame 14 might be experienced in response to a person standing behind the chair and leaning downwardly on the top edge (not shown) of the backrest.

When it is desired to recline the reclining chair from the upright position shown in FIG. 1 to the intermediate or TV recline position shown in FIG. 2, the chair's user, who is already seated in the chair, merely pushes forward on the arm rest frame 15 in the direction shown by phantom arrow 137. This causes the arm rest mounting plate 26 to move forwardly relative to the seat frame plate 23, thereby pivoting front 44 and rear 45 hanger links counterclockwise as shown in the figures. Once the front hanger link 44 is pivoted sufficiently counterclockwise that its pivot axis 47 connection with the arm rest mounting plate 26 passes forwardly of the front carrier link's pivot axis 35 connection with the four bar linkage's control mounting link 32, i.e., once the front hanger link 44 is removed from the overcenter position shown in FIG. 1 where the hanger link's center line 130 is to the left of center line 131 to a reverse overcenter line position where the hanger link's center line 130 is to the right of center line 131, then the user's weight on the seat frame (as shown by phantom arrow 127) tends to force the recliner linkage 16 and leg rest linkage 18 from the upright to the TV or intermediate recline position. And this effect is accentuated once the rear hanger link 45 is pivoted from its overcenter position to a reverse overcenter position, i.e., once the rear hanger link's center line 133 is pivoted from the left of center line 134 to the right of center line 134. This hanger 44, 45 linkage/four bar carry linkage 20, 30–32 structure makes the three-position all linkage recliner mechanism of this invention quite easy to open as it is, in effect, the user's own weight that causes the linkages 16, 18 to move from the upright to the recline position once the overcenter position 130, 133 of the front 44 and rear 45 hanger links have been effected by forward motion 137 of the arm rest frame 15.

More particularly, as the chair 10 is moved from the FIG. 1 upright to FIG. 2 intermediate recline position, note that the pivot axis 36 connection of rear carrier link 31 and control mounting plate 32 moves forwardly a distance D, and downwardly a distance D', see FIG. 2. This forward movement D occurs because the forwardly directed dog leg configured rear hanger link 31 pivots clockwise from a generally upright position where the rear carrier link's pivot axes 34, 36 are substantially above one another to an angled position where those pivot axes 34, 36 are on a substantially 45° angle relative to ground 22. This, of course, carries the chair's seat frame 13 and backrest frame 14 forwardly away from whatever object, e.g., wall, the chair 10 may be backed up against in its use location. Counterclockwise pivot motion of the front 44 and rear 45 hanger links from the upright to the intermediate recline position, as induced by clockwise pivot motion of front 30 and rear 31 carrier links, also causes primary drive link 83 to provide an outward thrust (shown by phantom arrow 138) to the double V leg rest linkage 18, thereby causing that linkage to move from the retracted FIG. 1 position toward the extended position shown in FIG. 2. The secondary drive link 93 also cooperates in this regard, i.e. it also functions to force the leg rest linkage from the retracted FIG. 1 position to the extended FIG. 2 position, as it transmits clockwise pivot motion of the front carrier link 30 (which is continued due to the user's weight 127 once the front 44 and rear 45 hanger link passes from their overcenter positions to their reverse overcenter positions, compare FIGS. 1 and 2) so as to continue driving the double V leg rest linkage 18 out to the fully extended FIG. 2 position. In other words, the primary 83 and secondary 93 drive links cooperate simultaneously during translation of the four bar linkage 20, 30–32, and front 44 and rear 45 hanger links, from the FIG. 1 to the FIG. 2 position to extend the leg rest frame 17 from the retracted position to the TV position.

The leg rest extension linkage 18 is located in the intermediate recline or TV position, as shown in FIG. 2, by stop pin 128 on the rear V link pair's front link 65 cooperating with stop edge 129 on the front V link pair's rear link 63, thereby preventing the acute angles 139, 140 defined between the scissors links 63, 65 from getting smaller. This, in turn, prevents further extension of the leg rest linkage 18 and further collapsing of the recliner linkage 16, thereby locating the chair 10 in the FIG. 2 position. Note particularly in this intermediate position that the rear recliner link 100 remains in the same position against top stop 107 as was the case when the chair was in the upright position. However, the rear edge 61 of the chair's seat frame 13 has dropped to some extent because of the rear carrier link 31's dog leg configuration, and the chair's arm rest frame 15 has moved forwardly relative to the stationary base 11 because the arm rest frame has been swung forwardly relative thereto through front 44 and rear 45 hanger links. However, the generally right angular configuration of the body support defined by the chair's backrest frame 14 and the chair's seat frame 13 remains the same. As the leg rest frame 17 is extended from the FIG. 1 to the FIG. 2 attitude, the primary drive link 83 (and, hence, the seat frame 13) is prevented from further reclining or tilting movement relative to ground 22 by the lock link because the lock link 85 maintains the primary drive link 83 in seated relation on stop 141 fixed to arm rest frame mounting plate 26 during extension of the leg rest linkage 18. Such is accomplished because stud 88 on the rear link 66 of the rear V link pair 65, 66 abuts against end 142 of the pivotable lock link's lost motion slot 92 to prevent tilting motion of the seat frame mounting plate 26 relative to the primary drive link 83 as the chair 10 moves from the FIG. 1 to the FIG. 2 position.

When it is desired to move the chair 10 from the intermediate position to the full recline position, i.e., from the FIG. 2 to FIG. 3 position, a chair's user, who is already seated in the chair 10, need merely lean back against the chair's backrest frame 14. In this regard, the chair's user exerts a rearwardly directed force as shown by phantom arrow 145. As the force 145 is exerted rearwardly against the chair's backrest frame 14, same induces counter-clockwise pivot motion in the full recline link 100. The full recline link 100 pivots on axis 36 until stop edge 106 abuts lower stop 108 fixed to the four bar linkage's control mounting link 32. This counter-clockwise motion of the full recline link 100 permits the backrest frame 14, as supported by the back support link 101, to tilt or recline relative to the seat frame 13. And this counter-clockwise motion of the full recline link 100 also induces counter-clockwise motion of the seat frame mounting plate 23 (and, hence, of the seat frame 13 and backrest frame 14) relative to the control mounting link 32. Because the seat frame mounting plate 23 and full recline link 100 are connected with the primary drive link 83 by control links 113, 114, the leg rest frame 17 also is elevated relative to ground simultaneously as the chair's backrest frame 14 reclines relative to the chair's seat frame 13 and as the seat frame's front edge 60 is elevated. This for the reason that the recliner control links 113, 114 cause the leg rest frame 17 to be pulled upward as shown by phantom arrow 146, i.e., to be pivoted counterclockwise about pivot axis 53 where the foot rest drive link 83 is connected with the arm rest mounting plate 26. This upward motion 146 of the leg rest frame 17 is limited by lock link 85 when pin 88 bottoms out against the outer end 147 of that link's lost motion slot 92 as shown in FIG. 3, thereby positioning the reclining chair 10 in the full recline position.

When the chair 10 is reverted from the full recline to intermediate recline position, the TV position is established when the primary drive link 83 abuts or seats against stop 141 fixed to the arm rest mounting plate 26, thereby preventing further downward or clockwise motion of that primary drive link and leg rest frame 17 relative to ground.

Having described in detail the preferred embodiment of my invention, what I desire to claim and protect by Letters Patent is:

1. An all linkage recliner mechanism for a three-position close-to-the-wall reclining chair, said chair being adapted to move between upright, intermediate recline and full recline positions while the back of the chair remains at a substantially fixed distance from a wall located behind the chair, said mechanism comprising a four bar linkage assembly which includes a stationary base member, front and rear carrier links each of which is connected to said base member, and a control mounting link pivotally connected at opposite ends to said front and rear carrier links, respectively, said four bar linkage functioning to prevent substantial rearward movement of the top of the chair's backrest as the chair moves from the upright to the recline positions, an armrest frame mounting plate, first linkage mounting means for connecting said armrest frame mounting plate to said four bar linkage for generally linear translatory movement of said armrest mounting plate relative to said base member upon movement of said chair between upright and reclined positions, a seat frame mounting plate, a backrest mounting plate, connected to said seat frame mounting plate, second linkage means for connecting said seat frame mounting plate and said a backrest mounting plate to said four bar linkage for movement relative to said armrest frame mounting plate and for generally pivotal translatory movement when said chair is moved between upright and reclined positions, said backrest frame mounting plate, seat frame mounting plate and armrest frame mounting plate being so connected to said four bar linkage that, upon slight initial forward motion of said armrest mounting plate relative to said base member, said chair will continue to move forwardly relative to said base member as a consequence of the weight of a person seated in the chair applying a downward force on said seat frame mounting plate, a legrest extension linkage pivotally connected to said seat frame mounting plate and to said armrest frame mounting plate, said legrest linkage cooperating with said four bar linkage to extend a legrest from retracted to extended position as said chair moves from the upright to the intermediate recline position, said second linkage means including a full recline linkage connected between said four bar linkage, said seat frame mounting plate and said backrest frame mounting plate, said backrest frame mounting plate being adapted to tilt rearwardly relative to said seat mounting plate as said chair moves from the intermediate to the full recline position, a rearward force provided against said backrest frame causing said full recline linkage to move said chair from the intermediate recline to the full recline position, and said full recline linkage comprising a full recline link pivotally connected to said seat frame mounting plate and to said control mounting link and a backrest support link pivotally connected to said backrest frame mounting plate and to said control mounting link, said full recline link and said backrest support link cooperating to permit the chair's backrest frame to tilt rearwardly relative to the chair's seat frame to the full recline position when said chair moves from the intermediate recline to the full recline position.

2. An all linkage recliner mechanism as set forth in claim 1, said first connector means comprising a front hanger link connected at one end to the front end of said arm rest frame mounting plate, and a rear hanger link connected at one end to the rear end of said arm rest mounting plate, the other ends of said hanger links being connected to said four bar linkage.

3. An all linkage recliner mechanism as set forth in claim 2, in which said front and rear carrier links are each connected to said control mounting link midway between the carrier links' ends, in which said front hanger link is connected at one end to said control mounting link and at the other end to said arm rest frame mounting plate, and in which said rear hanger link is connected at one end to said rear carrier link and at the other end to said arm frame mounting plate, at least one of said front hanger link and said rear hanger link being disposed in an overcenter position relative to the pivotal connection of said front and rear carrier links with said control mounting link when said chair is in the upright position, and disposed in a reverse overcenter position relative to said same pivotal connection when said chair is in the recline position.

4. An all linkage recliner mechanism as set forth in claim 2, said mechanism including a primary drive link pivotally connected to said arm rest frame mounting plate and to said leg rest extension linkage, said primary drive link causing said leg rest extension linkage to extend when the chair's arm rest is moved from the upright toward a recline position, and a secondary drive link connected between one of said hanger links and one of said carrier links, said secondary drive link also cooperating with said leg rest extension linkage to cause extension of said linkage into the extended position as said chair moves from the upright toward a recline position.

5. An all linkage recliner mechanism as set forth in claim 4, said mechanism further comprising a stop fixed to said arm frame mounting plate, said stop being adapted to cooperate with said primary drive link to aid in locating said chair in the intermediate recline position, and a lock link pivotally connected to said leg rest extension linkage and to said arm rest mounting plate, said lock link cooperating with said full recline link to define the upside limit of said leg rest frame when said chair is positioned in the full recline position.

* * * * *